US005099951A

United States Patent [19]

Stockwell

[11] Patent Number: 5,099,951

[45] Date of Patent: Mar. 31, 1992

[54] APPARATUS FOR USE IN AUTOMOBILE REPAIR

[76] Inventor: Stanley Stockwell, c/o Stockwell Engineering, Inc., 1744 Aberdeen Rd., Baltimore, Md. 21234

[21] Appl. No.: 709,192

[22] Filed: Jun. 3, 1991

[51] Int. Cl.[5] ..... E04G 7/02; E04G 1/28; B25H 5/00

[52] U.S. Cl. ..... 182/20; 182/151; 182/222; 182/230; 248/165

[58] Field of Search ..... 182/20, 151, 116, 230, 182/181, 222; 248/165

[56] References Cited

U.S. PATENT DOCUMENTS

| | | | |
|---|---|---|---|
| 494,358 | 3/1893 | Weeks | 182/151 |
| 2,970,668 | 2/1961 | Snyder | 182/116 |
| 3,976,155 | 8/1976 | Each | 182/116 |
| 4,072,209 | 2/1978 | Bolis | 182/116 |
| 4,498,264 | 1/1989 | Miller | 182/230 |
| 4,618,029 | 10/1986 | Lowry | 182/116 |
| 4,779,294 | 10/1988 | Miller | 248/165 |

*Primary Examiner*—Reinaldo P. Machado
*Attorney, Agent, or Firm*—Simpson & Simpson

[57] ABSTRACT

A collection of parts which can be assembled to form a cage-like structure, usable with or without a mechanics creeper, to protect a mechanic working under a vehicle; a scaffold-like device that is placeable over the engine compartment of a vehicle and which provides support portions enabling support of a mechanic over the engine compartment; and a support device which can support, among other things, large objects such as an automobile engine.

4 Claims, 5 Drawing Sheets

APPARATUS FOR USE IN AUTOMOBILE REPAIR

TECHNICAL FIELD

The present invention relates generally to a collection of parts able to be assembled in various manners to form, among other things, a scaffold-like unit for supporting a mechanic in a working position above a working point, a protection device to be used with or without a mechanic's creeper to prevent injury to a mechanic in a working position below a working point, and a hoist frame for supporting heavy objects such as, for example, an automobile engine.

BACKGROUND OF THE INVENTION

When working on machines, for example, an automobile, it is necessary for a mechanic to work in various positions on, above, and underneath the automobile. When working above an automobile, it is desirable for the mechanic to be situated directly above the area being worked upon so that the mechanic can best view the work area. In addition, it is desirable that the mechanic may have free use of his or her hands. U.S. Pat. No. 4,618,029 to Lowry discloses an adjustable apparatus which includes a support means parallel to the ground to enable a mechanic to lean out over an engine and easily work on the engine below him. Vertical support members are situated at one end of the support means; no support structure is suggested at the other end of the Lowry structure.

U.S. Pat. No. 4,072,209 to Bolis and U.S. Pat. No. 2,970,668 to Snyder both teach support means for supporting a mechanic at an angular position over an engine to alleviate stress on the back, neck, etc.

It also desirable for a mechanic to be protected from objects falling down from the machine being repaired when the mechanic is underneath the machine. U.S. Pat. No. 1,431,383 to Edwards teaches the use of a protective shield attached to a mechanic's creeper to deflect foreign matter falling towards the eyes of the mechanic. The device of Edwards does not protect against injury due to the falling of large objects. None of these devices will adequately support a person above a work area, nor can they be used to protect a person from injury caused by heavy falling objects.

SUMMARY OF THE INVENTION

It is an object of this invention to provide a device for comfortably, safely and stably supporting a person over a work area while permitting freedom of motion of the person's arms.

It is another object of this invention to provide a device which enables a person to work underneath a machine, such as an automobile, and be protected against injury caused by falling of large objects, including the automobile itself.

It is a further object of this invention to provide a support device for supporting large objects off of the ground.

It is a still further object of this invention to provide a collection of parts which can be assembled to form any of the devices set forth in the preceding three paragraphs.

According to the present invention, there is provided a collection of parts which can be assembled to form a cage-like structure, usable with or without a mechanics creeper, to protect a mechanic working under a vehicle; a scaffold-like device that is placeable over the engine compartment of a vehicle and which provides support portions enabling support of a mechanic over the engine compartment; and a support device which can support, among other things, large objects such as an automobile engine.

These together with other objects and advantages which will be subsequently apparent, reside in the details of construction and operation is more fully hereinafter described and claimed, reference being had to the accompanying drawings forming a part hereof, wherein like numerals refer to like parts throughout.

DESCRIPTION OF THE PREFERRED EMBODIMENTS

The present invention comprises pipes formed into three basic shapes and connectable to form various useful devices.

Figure 1:
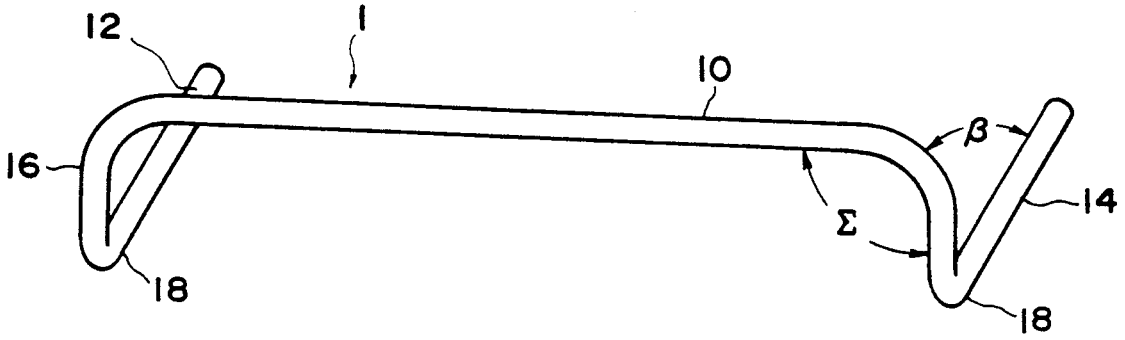
FIG. 1 is a perspective view of a handlebar portion according to the present invention.
Figure 2:
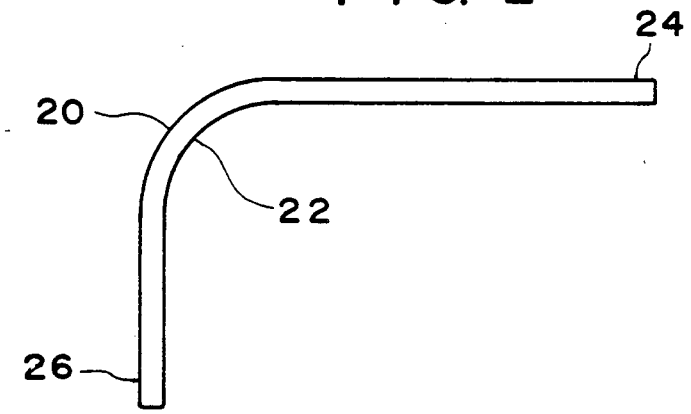
FIG. 2 is a side view of an elbow portion according to the present invention.
Figure 3:
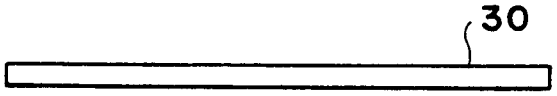
FIG. 3 is a side view of a straight portion according to the present invention.

FIGS. 1–3 illustrate the three basic pipe shapes of the present invention. FIG. 1 illustrates what is hereinafter referred to as a "handlebar" portion. The handlebar portion comprises a length of tubing 1 having, for example, an outside diameter of 1.3 inches and having a center portion 10 and ends 12 and 14. Preferably, the tubing 1 comprises 40 gauge water pipe. Ends 12 and 14 each have two bends 16 and 18 formed therein. Each bend 16 forms an angle $\Sigma$ of approximately 115 degrees. Each bend 18 forms an angle $\beta$ of approximately 90 degrees. The tubing bent in this manner forms a handlebar shape.

FIG. 2 illustrates an elbow portion 20. Elbow portion 20 is a piece of tubing similar to that used to form the handlebar portion 1 illustrated in FIG. 1, however, it is preferable to use Electrical Metallic Tubing (EMT) having an outside diameter of 1.5 inches and a thickness of 0.065 inches. The tubing is bent to form bend 22 such that the arms 24 and 26 of the elbow are equal in length and perpendicular to each other.

FIG. 3 illustrates a coupling portion 30. The coupling portion 30, in a preferred embodiment, is a straight piece of tubing of the same gauge and thickness as that used for the handlebar portions, but the inside diameter of coupling portion 30 is such that the ends 12 and 14 of handlebar portion 1 and ends 24 and 26 of elbow portion 20 will fit snugly inside the ends of coupling portion 30. As will be more fully described below, several coupling portions of various lengths will be used.

Figure 4:
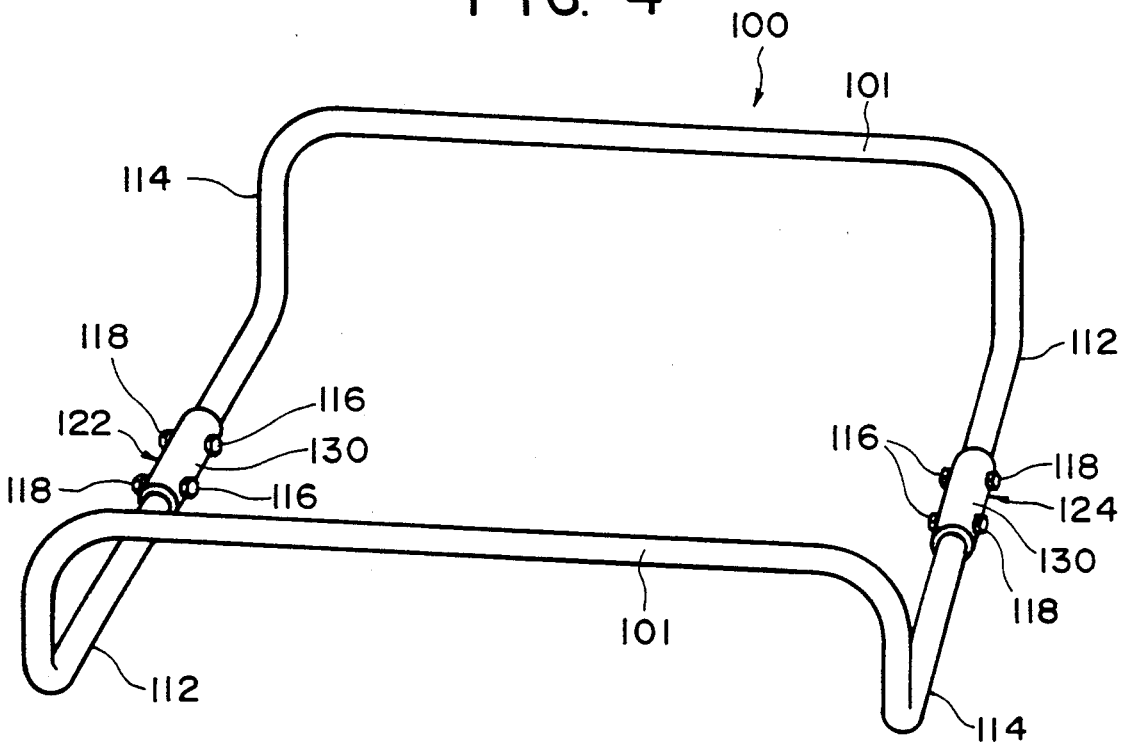
FIG. 4 is a perspective view of a first structure assembled in accordance with the present invention.
Figure 5:
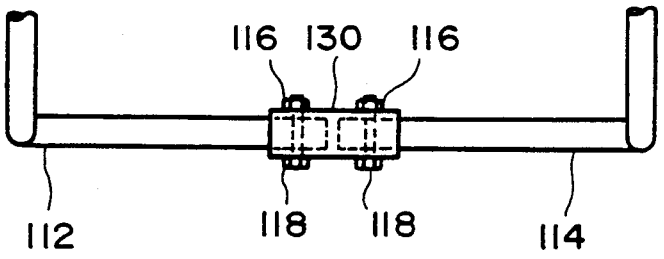
FIG. 5 is a top view of end portion 124 of the structure of FIG. 4.

FIGS. 4 and 5 illustrate a first structure 100, having end portions 122 and 124, formed using a combination of the pieces described in FIGS. 1–3. As shown in FIG. 4, two handlebar portions 101 are coupled together using two coupling portions 130. For this structure, the coupling portions 130 should be approximately 10" to 16" in length.

FIG. 5 is a top view of end portion 124 of assembly 100. The assembly 100 is assembled by inserting the ends 112 and 114 of handlebar portions 101 into coupling portions 130. The ends 112 and 114 of the handlebar portions 101 are fixedly attached to coupling portion 130 utilizing, for example, nuts 116 and 118, bolts, pins or other connection means inserted into holes drilled in through the ends of 112 and 114 and through coupling portion 130 as shown in FIG. 5.

When assembled as described above, the pieces form a cage-like type structure which may be used as follows. The vehicle to be worked on is jacked up to the desired height. At minimum, in order to use the assembly 100, the vehicle must be jacked up to a height enabling the assembly 100 to be slipped underneath the vehicle. Once the assembly 100 is inserted underneath the car, the user may crawl underneath the car and be protected by it. Preferably, the user will crawl between the two handlebar portions 101, so that, in the event that the vehicle were to fall off the jack, the user would be inside the "cage" formed by the assembly 100. The assembly 100 will support the vehicle and allow the user to get out from under the vehicle safely.

Figure 6:
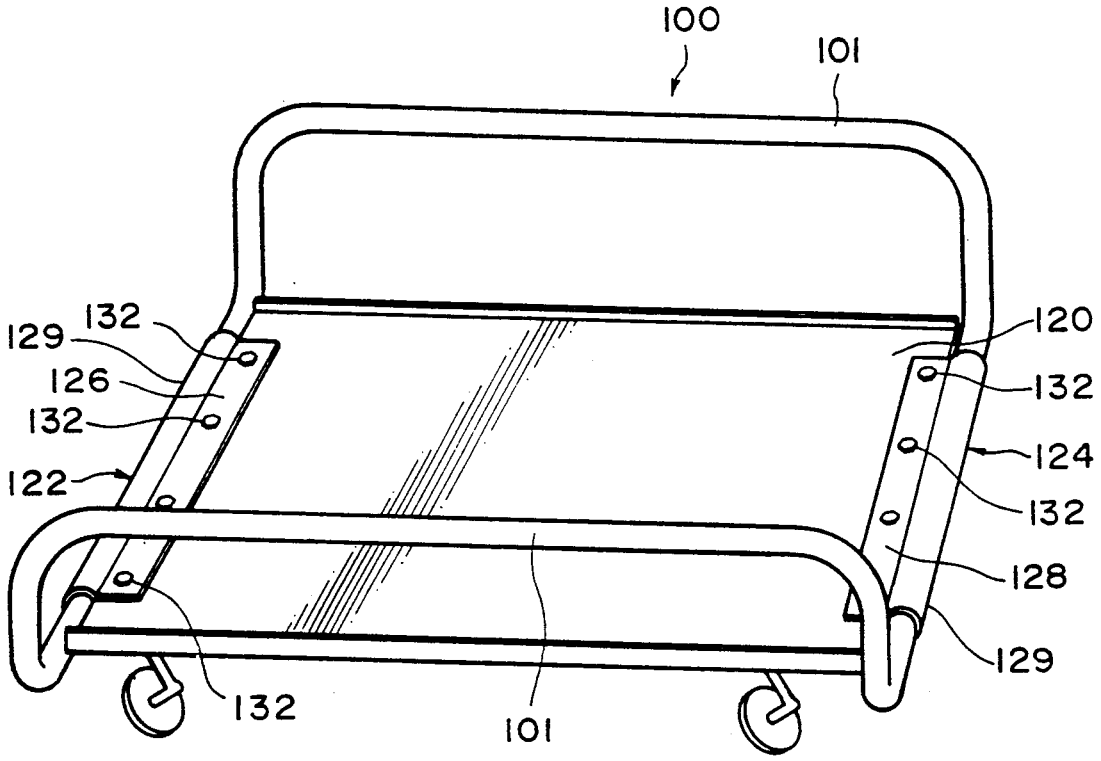
FIG. 6 is a perspective view of an alternative embodiment of the structure of FIG. 5.
Figure 7:
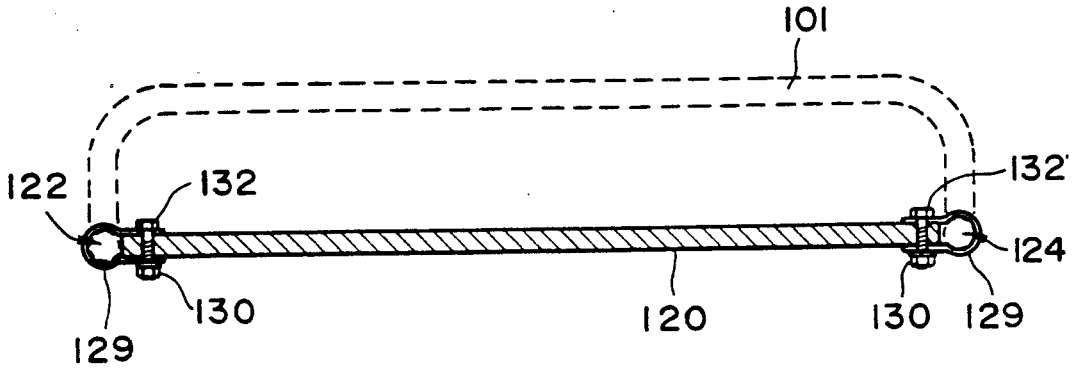
FIG. 7 is a cross sectional side view of the assembly of FIG. 6.

FIGS. 6 and 7 illustrate an alternative embodiment in which the assembly 100 is coupled with a mechanic's "creeper" 120 to allow easy maneuvering of the roll bar assembly while maneuvering underneath the vehicle. FIG. 6 is a perspective view of assembly 100 with the mechanic's creeper attached. FIG. 7 is a cross-sectional side view of the assembly of FIG. 6.

A standard mechanic's creeper is available from most auto parts stores or Sears, Roebuck and Co., and is approximately 36" in length. The handlebar portions 101 are formed so that the distance between end portions 122 and 124 is such that the mechanic's creeper can fit snugly between them i.e., the length of the creeper should be slightly smaller than the distance between end portions 122 and 124. The assembly 100 is placed over the creeper and is attached to ends 126 and 128 of the creeper 120 using, for example, strapping material 129 wrapped around the end pieces 122 and 124 of the assembly 100 and bolted into the creeper 120, as shown in FIG. 6, using nuts 130 and bolts 132. The strapping material can be, for example, a piece of sheet metal wrapped around end pieces 122 and 124 and bolted to the creeper. When attached in this manner, the user can lie comfortably on the creeper 120 and maneuver underneath the vehicle while being protected by the cage-like structure.

Figure 8:
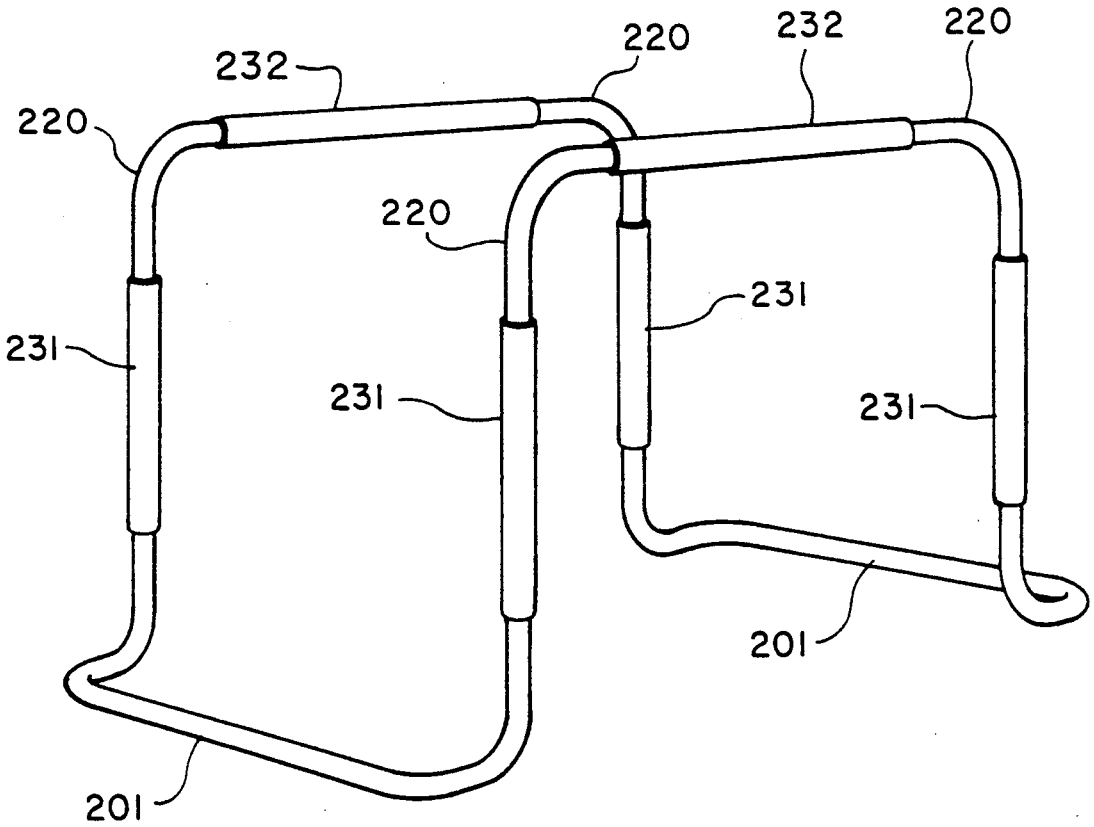
FIG. 8 is a perspective view of a second structure assembled in accordance with the present invention.
Figure 9:
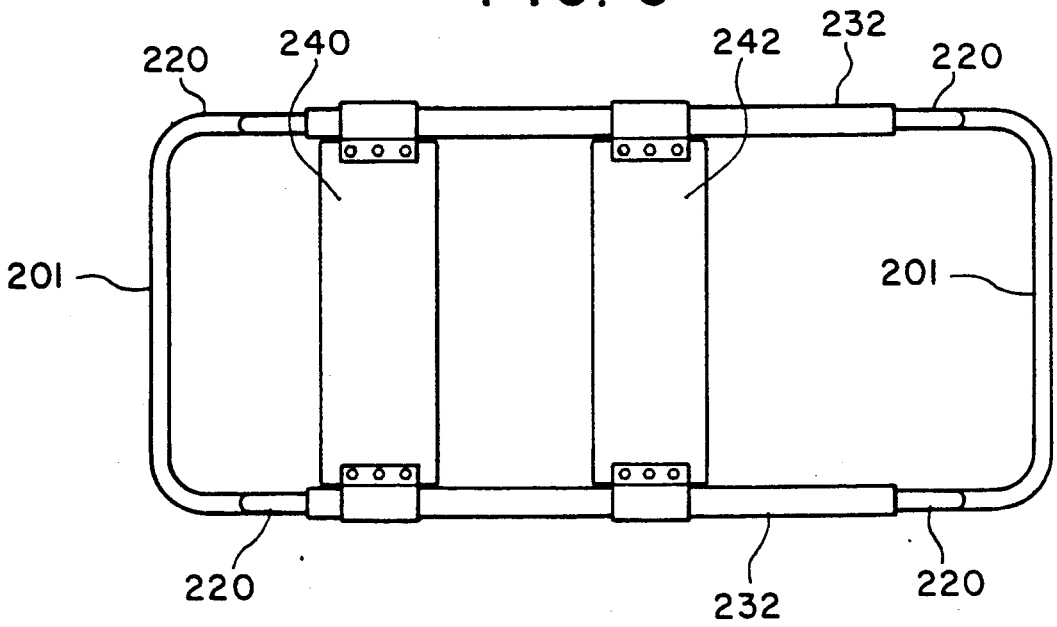
FIG. 9 is a top view of the structure of the FIG. 8.

FIGS. 8 and 9 illustrate a second structure 200, herein after referred to as a "support structure," formed using a different combination of the pieces described in FIGS. 1–3. As shown in FIG. 8, two handlebar portions 201 (FIG. 1), four elbow portions 220 (FIG. 2), four coupling portions 231 (FIG. 3) of a length approximately one foot longer than the distance from the ground to the highest portion of the hood of the vehicle, and two straight portions 232 (FIG. 3) of a length approximately one foot wider than the width of the vehicle are required.

The support structure 200 is assembled by inserting one end of each of the four coupling portions 231 onto the ends of the handlebar portions 201. An elbow 220 is then coupled to the other end of each of the four coupling portions 230. Finally, the elbow portions are coupled to each other as shown in FIG. 6 using the coupling portions 232. Each of the sections are secured to each other in the same manner as described with respect to FIG. 5.

FIG. 9 is a top view looking down onto support structure 200. When assembled, a creeper 240 is slideably attached across the two coupling portions 232 as shown in FIG. 9, to provide a moveable surface across which the user can lie. The creeper can be attached in the same manner as described with respect to FIGS. 6 and 7. If desired, a second creeper can be attached to provide a work surface/tool tray or to provide further support for the user. An assembly so formed can be used by a mechanic to lean or to lie over the engine to be worked on, thereby reducing the back strain caused by leaning over the engine without the support. In addition, tools are easily accessible and the mechanic's hands are free to move about to work on the engine below. The user can lie across both creepers or can lean on one and use the other to hold tools.

Figure 10:
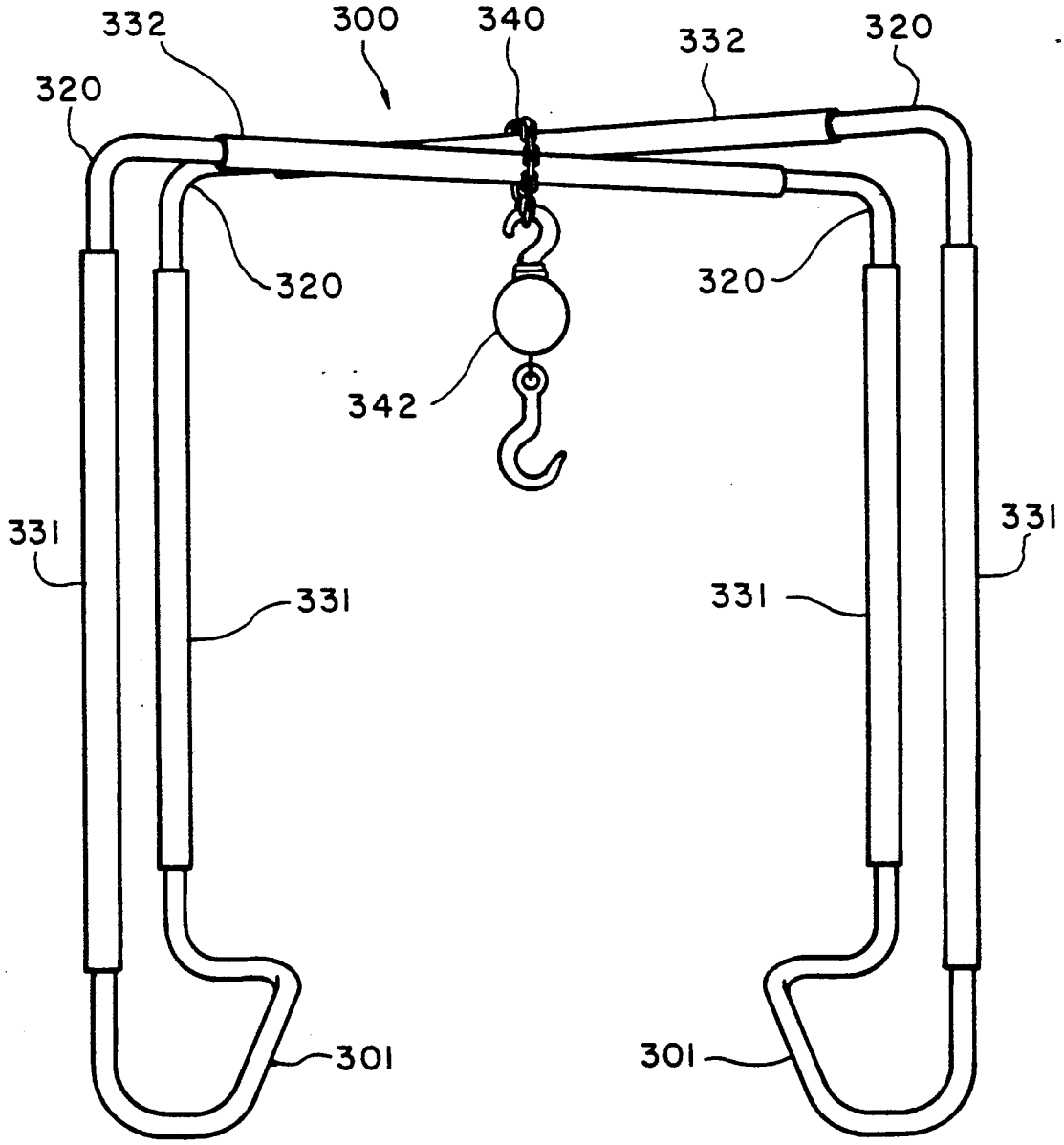
FIG. 10 is a perspective view of a third structure assembled in accordance with the present invention.

FIG. 10 illustrates a third structure 300, hereinafter referred to as a hoisting device, formed using another combination of the basic pieces described in FIGS. 1–3. In FIG. 8, two handlebar portions 301 (FIG. 1), four elbow pieces 320 (FIG. 2), four coupling portions 331 of a length approximately 1½ times the distance from the ground to the highest portion of the hood of a vehicle, and two coupling portions 332 of a length approximately two feet longer than the width of the vehicle are required.

To assemble the hoisting device 300, the coupling portions 331 are inserted onto the four ends of the handlebar portions 301 as shown in FIG. 10. The four elbow portions 320 are inserted into the other end of each of the coupling portions 331. The elbows 320 ar coupled to each other using coupling portions 332, as shown in FIG. 10. Each of the sections are secured to each other in the same manner as described with respect to FIG. 5. Where the two coupling portions 332 cross each other, a chain 340 or other similar means is wrapped around the intersecting cross pieces, and a hoisting mechanism 342 for example, a block and tackle or similar device is connected to the chain. The device thus assembled can be placed over, for example, the engine of an automobile. If the motor mounts of the vehicle are then loosened and the engine of the vehicle is attached to the hoisting means 342, the engine can be pulled out from the vehicle and then the vehicle can be moved away from the engine, leaving the engine hanging from the hoisting device 300. It then can be lowered onto a hand truck or worked on while it hangs from the hoisting device 300.

As discussed above, at least three different structures for use in automobile repair can be formed using the three basic pieces illustrated in FIGS. 1–3. The device can be disassembled and stored easily, perhaps even in the trunk of a car, for use in emergency situations.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly all suitable modifications and equivalents may be resorted to falling within the scope of the invention. For example, the disclosed invention includes elbow portions having "arms" of equal length. However, the invention can instead be made using elbow portions having "arms" of different lengths. In addition, various other materials and pipe sizes can be used other than those disclosed herein.

What is claimed is:

1. A kit assemblable into at least three distinct mechanic's tools, said tools including a protection device for protecting a mechanic working underneath a vehicle, a support device for supporting a mechanic above a vehicle or a hoisting device for hoisting and supporting large objects, comprising:

two handlebar shaped portions;

four elbow shaped portions;

four coupling portions of a first predetermined length;

two coupling portions of a second predetermined length;

hoisting means for supporting and hoisting large objects;

a mechanic's creeper;

first fastening means for selectively fastening said handlebar portions, said elbow portions, and said straight portions to each other; and second fastening means for fastening said mechanic's creeper to said handlebar portion or said straight portions.

2. A device for protecting a user from injury due to falling objects, comprising:

first handlebar portion including a first leg, a second leg, and an upper support portion;

a second handlebar portion including a first leg, a second leg, and an upper support portion;

a first coupling portion coupling said first leg of said first handlebar portion with said first leg of said second handlebar portion; and a second coupling portion coupling said second leg of said first handlebar portion with said second leg of said second handlebar portion.

3. A device for aiding in the repair of a vehicle, comprising:

first and second lower support means for supporting said device in an upright position;

horizontal support means for providing horizontal support over said vehicle;

first, second, third and fourth coupling means for coupling said first and said second lower support means to said first, second, third and fourth extension means; and support platform means couplable to said horizontal support means for supporting the user of the device.

4. A device for supporting large objects, for example, a motor vehicle engine, comprising:

first and second lower support means for supporting said apparatus in an upright position;

horizontal support means comprising first and second crisscross pipes coupled to each other at a point of intersection;

first, second, third and fourth coupling means for coupling said first and said second lower support means to said horizontal support means; and hoisting means coupled to said point of intersection for grasping and hoisting said large object.

* * * * *